United States Patent [19]

Okuma et al.

[11] Patent Number: 4,472,992

[45] Date of Patent: Sep. 25, 1984

[54] ELECTRONIC MUSICAL INSTRUMENT

[75] Inventors: Yoshikazu Okuma, Katano; Takeshi Ogura, Habikino; Kimimaro Tamura, Hirakata, all of Japan

[73] Assignee: Matsushita Electric Industrial Co., Ltd., Kadoma, Japan

[21] Appl. No.: 478,375

[22] Filed: Mar. 24, 1983

Related U.S. Application Data

[63] Continuation of Ser. No. 258,556, Apr. 29, 1981, abandoned.

[30] Foreign Application Priority Data

Apr. 30, 1980 [JP] Japan ..... 57376

[51] Int. Cl.[3] ..... G10F 1/00

[52] U.S. Cl. ..... 84/1.03; 84/DIG. 22; 84/1.17

[58] Field of Search ..... 84/1.03, 1.01, DIG. 22, 84/1.24, DIG. 2, 1.17

[56] References Cited

U.S. PATENT DOCUMENTS

| | | | |
|---|---|---|---|
| Re. 29,144 | 3/1977 | Bunger | 84/1.01 |
| 4,065,993 | 1/1978 | Hirose | 84/DIG. 22 |
| 4,129,055 | 12/1978 | Whittington et al. | 84/DIG. 22 |
| 4,282,786 | 8/1981 | Deutsch et al. | 84/DIG. 22 |
| 4,295,402 | 10/1981 | Deutsch et al. | 84/DIG. 22 |

*Primary Examiner*—Forester W. Isen

*Attorney, Agent, or Firm*—Wenderoth, Lind & Ponack

[57] ABSTRACT

An electronic musical instrument wherein a function for automatically detecting the musical performance mode is provided by the condition of a hand keyboard, a foot keyboard, and a chord type specifying circuit for one finger use, etc. so as to simplify the operation of causing a chord to be stored.

8 Claims, 9 Drawing Figures

ELECTRONIC MUSICAL INSTRUMENT

This application is a continuation of now abandoned application Ser. No. 258,556 filed 4-29-81.

BACKGROUND OF THE INVENTION

The present invention relates to an electronic musical instrument and, more particularly, to a chord storing apparatus to be employed in the instrument which is able to simplify the operation of causing a chord to be stored.

According to the chord storing apparatus of the conventional electronic musical instrument, to cause the chord to be stored, a record button was depressed to put a chord storing apparatus into a record mode, a method of determining a chord was selected by a musical performance mode specifying button, a chord was determined through depression of the keyboard or the like in accordance with the musical performance mode, and the inputting operation of the chord length specification for determining the length of the chord was required to be performed. The musical performance mode specification button refers to a button for determining a musical performance mode, such as: a one finger mode, which is a musical performing method of determining a chord through depression of one key of the keyboard; a finger mode, which is a musical performing method of determining a chord through depression of a plurality of hand keyboards in accordance with the composing sound of the chord or a separated pedal mode, which is a performing method for determining the chord through selection of the bass sound of the chord, by a pedal keyboard or foot keyboard, through the depression of the composing sound of the chord by a manual keyboard or hand keyboard (hereinafter they are referred to as one finger mode, finger mode, separated pedal mode, and are called musical performance modes as a general term).

Referring to FIG. 1, a manual keyboard or hand keyboard 1 is connected to a circuit 2 for detecting depressed key note names. A note name corresponding to the keyboard depressed by the hand keyboard 1 is depressed so that hand keyboard note name information can be provided. A pedal keyboard or foot keyboard 3 is connected to a circuit 4 for detecting depressed note names. A note names corresponding to the keyboard depressed by the foot keyboard 3 is detected so that foot keyboard note name information can be provided. A circuit 5 for specifying a finger chord type specifies the information of chord types (major, minor, seventh, etc.) in the one finger mode, whereby the chord type information for one finger use is provided. A circuit 6 for specifying musical performance specifies the performance mode in accordance with the musical performance mode of the one finger, finger or the like selected by the performer. A circuit 7 for distinguishing chords distinguishes chords, to which the musical performance mode information, the hand keyboard note name information, the foot keyboard note name information, and the chord type information for one finger are inputted, and further distinguishes chords depressed by the hand keyboard note name information, the foot keyboard note name information and the chord type information for one finger use in accordance with the performance mode to thereby detect the chord information (C major, E minor, etc.). A chord information detecting apparatus 8, which is composed of the hand keyboard 1, the depressed key note name detecting circuit 2, the foot keyboard 3, the depressed key note name detecting circuit 4 and the chord type specifying circuit 5 for one finger use, as described hereinabove, detects the chord information of the keyboard depressed in accordance with the musical performance mode. A chord length specifying circuit 9 outputs the information as to the time duration (one bar, half a bar, etc.) of the chord information and such time duration information is stored in a memory 11 by a write circuit 10.

However, under such conventional construction as described hereinabove, the chord detecting apparatus 8 had no functions for automatically detecting the musical performance mode. To store the chord, the musical performance-mode specifying circuit 6 had to be operated to specify the musical performance mode, thus resulting in extremely difficult operation.

SUMMARY OF THE INVENTION

An object of the present invention is to provide an electronic musical instrument of such characters which can eliminate the disadvantages inherent to the conventional as described hereinabove, and in which the musical performance mode is not required to be specified in the chord storing operation so that the operation can be simplified and the operational errors can be reduced.

Another object of the present invention is to provide an electronic musical instrument wherein a function for automatically detecting the musical performance mode is provided by the condition of the hand keyboard, the foot keyboard, the chord type specifying circiut for one finger use, etc. to simplify the operation causing the chord to be stored.

According to the present invention, there is provided an electronic musical instrument comprising: a keyboard apparatus for players to perform the melody or music accompaniment of a music, a keyboard information detecting means for detecting information as to the key depressed by said keyboard apparatus, a musical performance mode detecting means for automatically detecting a performing method of determining a chord according to the output from said keyboard information detecting means, and a chord distinguishing means for distinguishing the chord in accordance with the output from said keyboard information detecting means and the output from said performing mode detecting means, to thereby simplify the operation for causing the chord to be stored.

BRIEF DESCRIPTION OF THE DRAWINGS

These and other objects, features, aspects, and advantages of the present invention will become more apparent from the following detailed description of the present invention when taken in conjunction with the accompanying drawings, in which.

DESCRIPTION OF THE PREFERRED EMBODIMENTS

Figure 1:
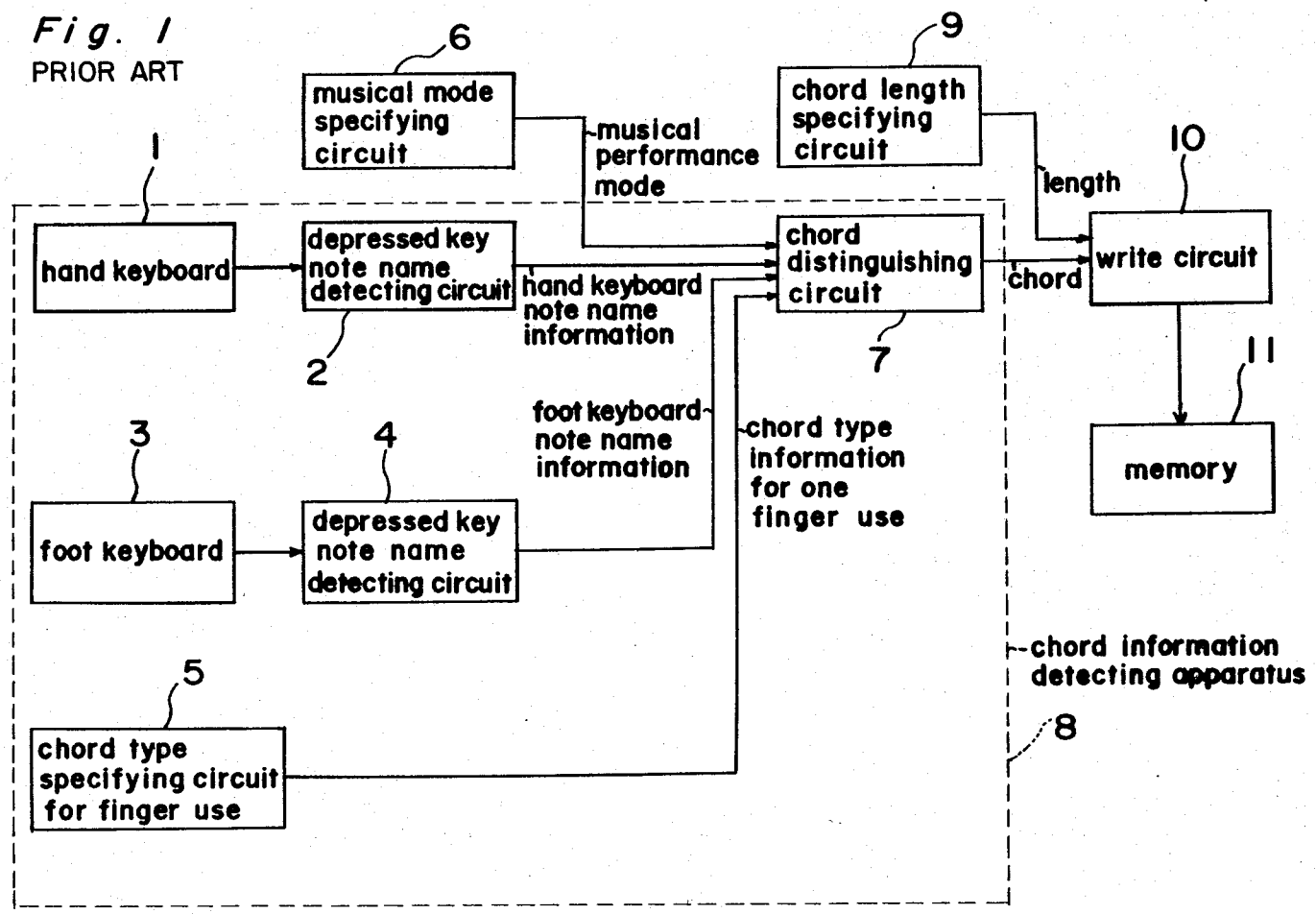
Fig. 1 PRIOR ART
FIG. 1 is a block diagram of a conventional example, as referred to above.

Before the description of the present invention proceeds, it is to be noted that like parts are designated by like reference numerals throughout the accompanying drawings.

Figure 2:
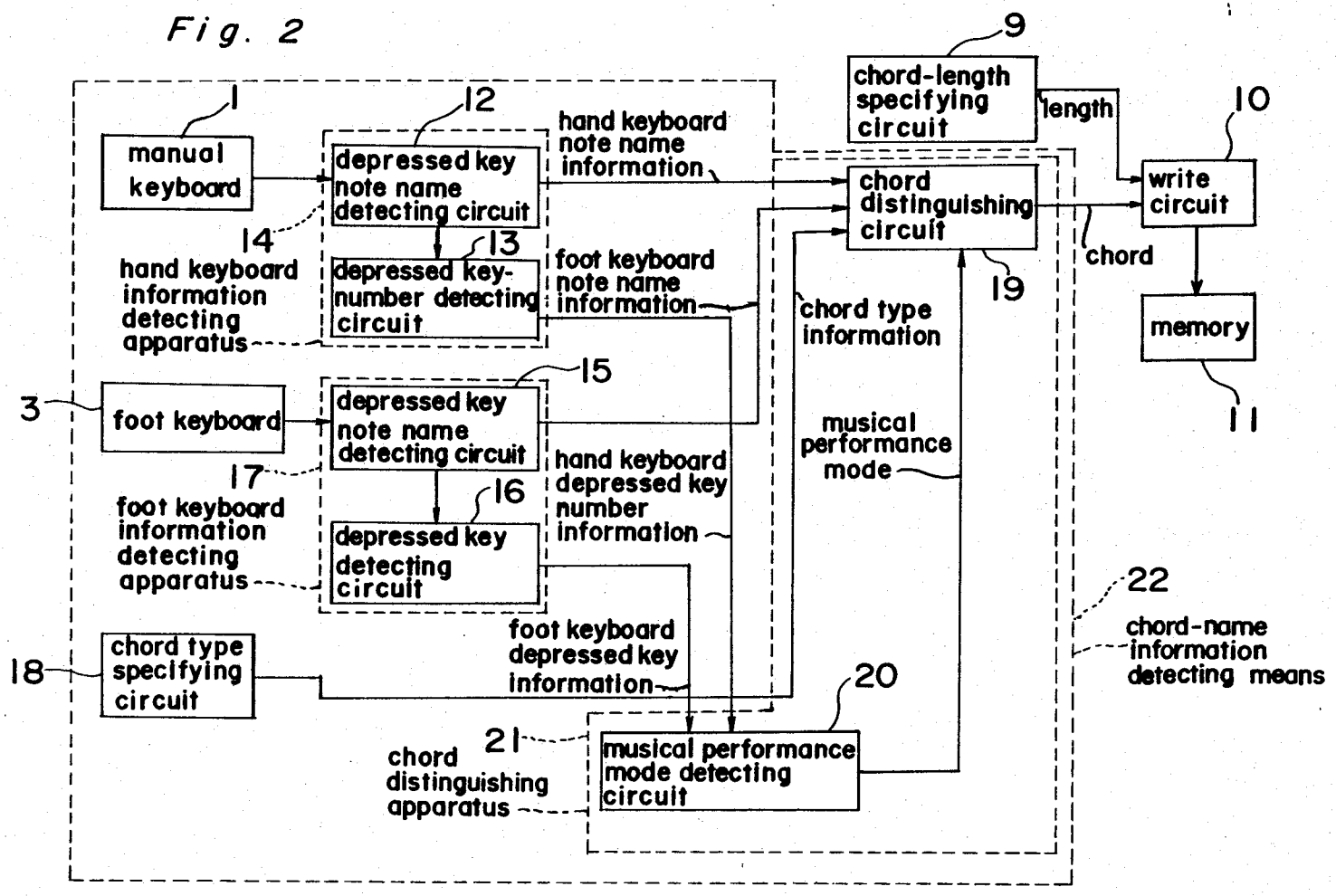
FIG. 2 is a block diagram of an electronic musical instrument, in one embodiment of the present invention.

Referring to FIG. 2, a hand keyboard 1 is connected to a hand keyboard information detecting apparatus 14 composed of a depressed key note name detecting circuit 12 and a depressed-key-number detecting circuit 13 so that the depressed key note name and the depressed-key-number of a key depressed on the hand keyboard 1 are automatically detected.

Figure 3:
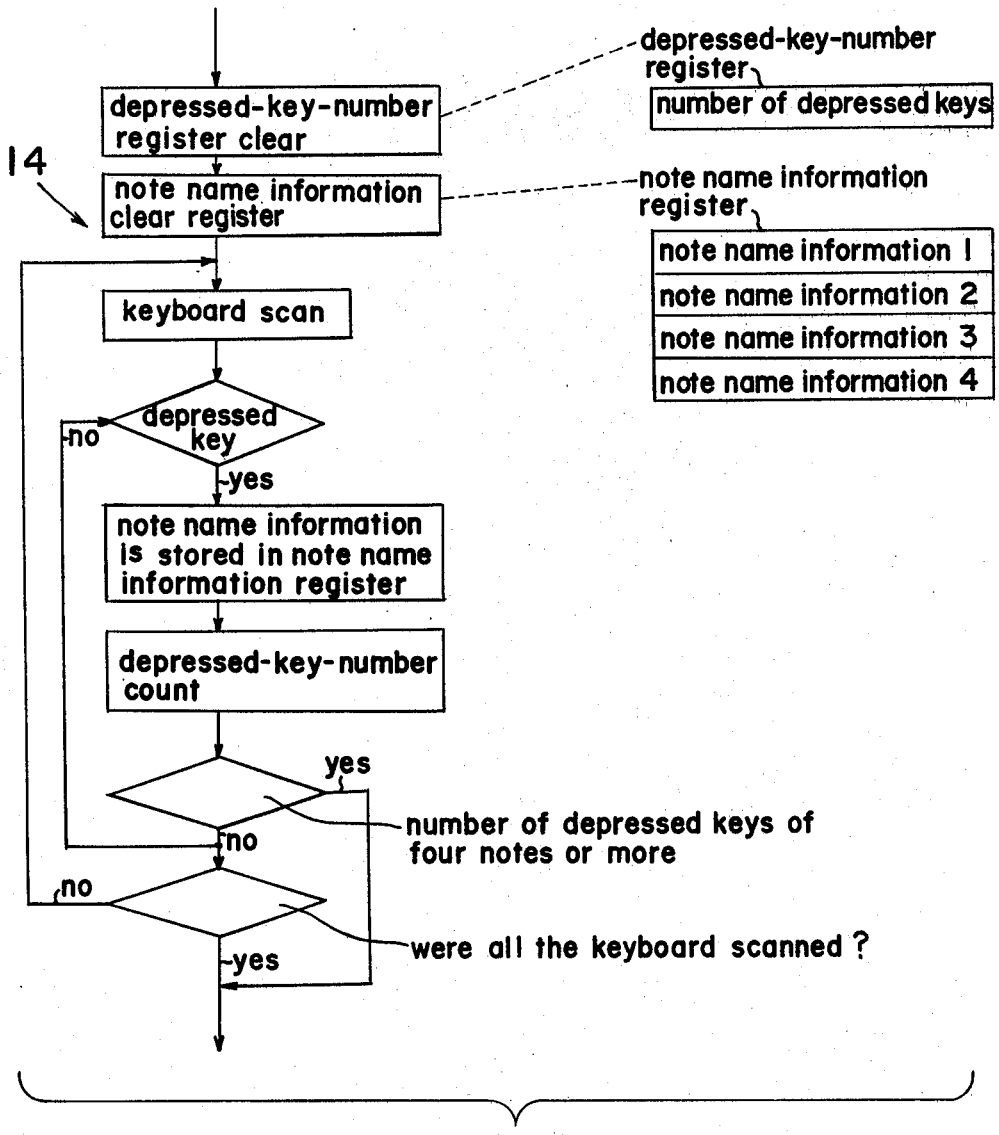
FIG. 3 is a sequence flow chart of the hand keyboard information detecting circuit of FIG. 2.

FIG. 3 shows the sequence of the hand keyboard information detecting apparatus 14. The hand keyboard information detecting apparatus 14 is provided with four note-name information registers and one depressed-key-number register, these registers being shown in FIG. 3. The sequence of these registers will be described hereinafter with reference of FIG. 3. The note name information register and the depressed-key-number register are initially cleared and then the scanning operation of the hand keyboard 1 starts. When the depressed key exists through the scanning operation of the hand keyboard 1, note-name information corresponding to a key depressed on the hand keyboard is sequentially stored in the note name information register. Simultaneously, the number of depressed keys is counted and the counted results are accumulated in the depressed-key-number register. When the number of depressed keys accumulated by the depressed-key-number register becomes four notes or more, the scanning operation stops to complete the sequence. When the number of depressed keys is four notes or less or no depressed keys exist, a distinguishing operation is effected as to whether or not all the hand keyboards 1 have been scanned. When the scanning operation is not completed, the sequence returns to the sequence of the keyboard scanning operation. When the scanning operation is completed, the sequence is completed. The hand keyboard information detecting apparatus 14 stores the note name information of the depressed key and the depressed-key-number of the hand keyboard 1 in the respective registers through the sequence operation in accordance with FIG. 3.

Referring to FIG. 2, a foot keyboard 3, which is composed of a depressed key note name detecting circuit 15 and a depressed key detecting circuit 16, is connected to a foot keyboard information detecting apparatus 17 to detect the note name information of a key depressed by the foot keyboard 3 and the existence of the depressed key. In the case of the foot keyboard, the note name information, which is one note, will do. As a result, the number of depressed keys is not required to be detected. All that is required to be done is to detect whether or not the depressed key exists. The sequence of the foot keyboard information detecting apparatus 17 is not required to be fully described, since the sequence is similar to the sequence (see FIG. 3) of the hand keyboard information detecting apparatus 14.

Figure 4:
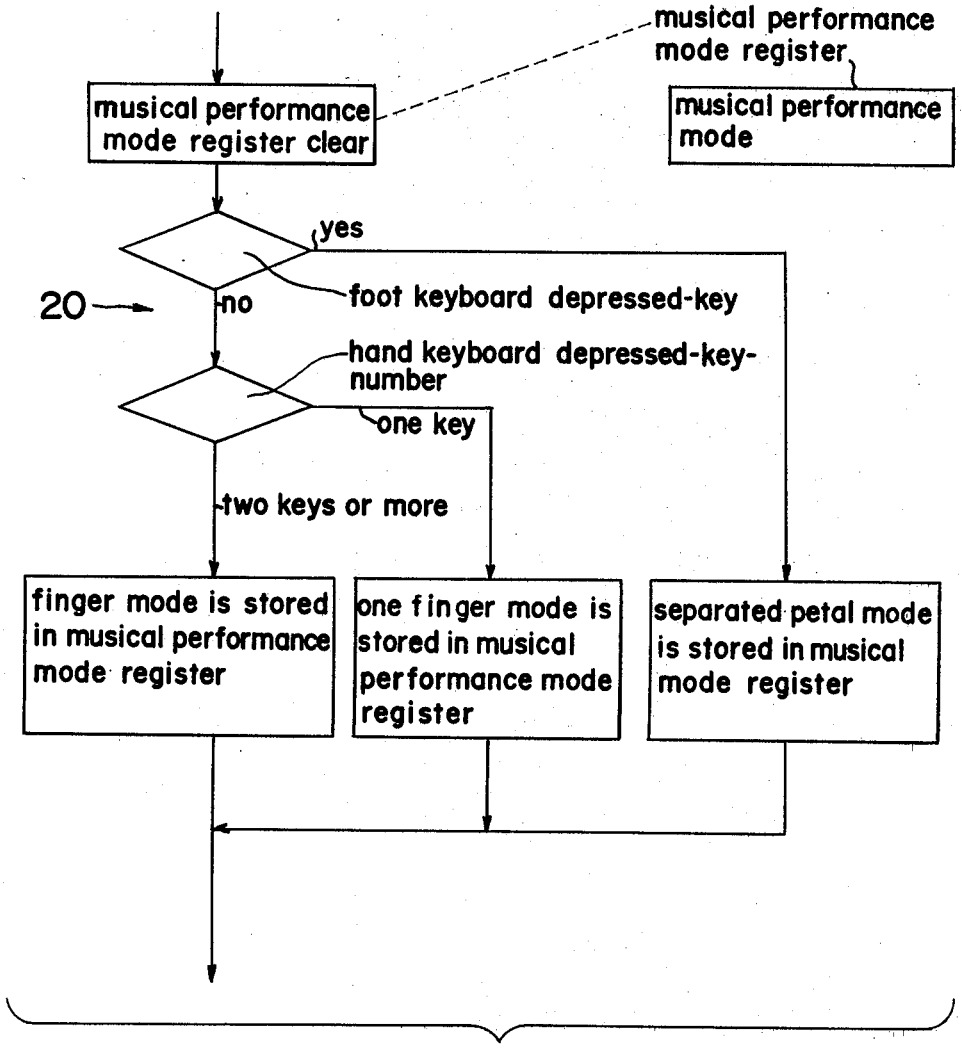
FIG. 4 is a sequence flow chart of the musical performance mode detecting circuit of FIG. 2.

A musical performance mode detecting circuit 20 of FIG. 2 automatically detects the musical performance mode by a hand keyboard depressed-key-number information to be provided by a depressed-key-number detecting circuit 13 and a foot keyboard depressed key information to be provided by a depressed-key detecting circuit 16. The sequence of a musical performance mode detecting circuit 20 will be described hereinafter with reference of FIG. 4. First, if the foot keyboard depressed-key information is distinguished and the foot keyboard is kept depressed, the musical performance mode becomes a separated pedal mode. When the foot keyboard is not depressed, the hand keyboard depressed-by-number information is distinguished. When the depressed key of the hand keyboard is one, the mode becomes a one finger mode. When the number of depressed keys of the keyboard becomes equal to 2 or more, the mode becomes a fingered mode. Each of these modes is stored in the musical performance mode register shown in FIG. 4.

Referring to FIG. 2, a chord type specifying circuit 18 specifies the type (minor, seventh, etc.) of the chords so as to output the chord type specifying information, which is composed of specification existence information and chord type information in the existence of the specification.

Referring to FIG. 2, a chord distinguishing circuit 19 distinguishes the chords (C major, E minor, etc.), in accordance with a musical performance mode detected by a musical performance mode detecting circuit 20, by a hand keyboard note name information to be provided from a depressed-key-note-name detecting circuit 12, a foot keyboard note name information to be provided from the depressed-key-note-name detecting circuit 15 and a chord type specified information to be specified by the chord type specifying circuit 18.

Figure 5:
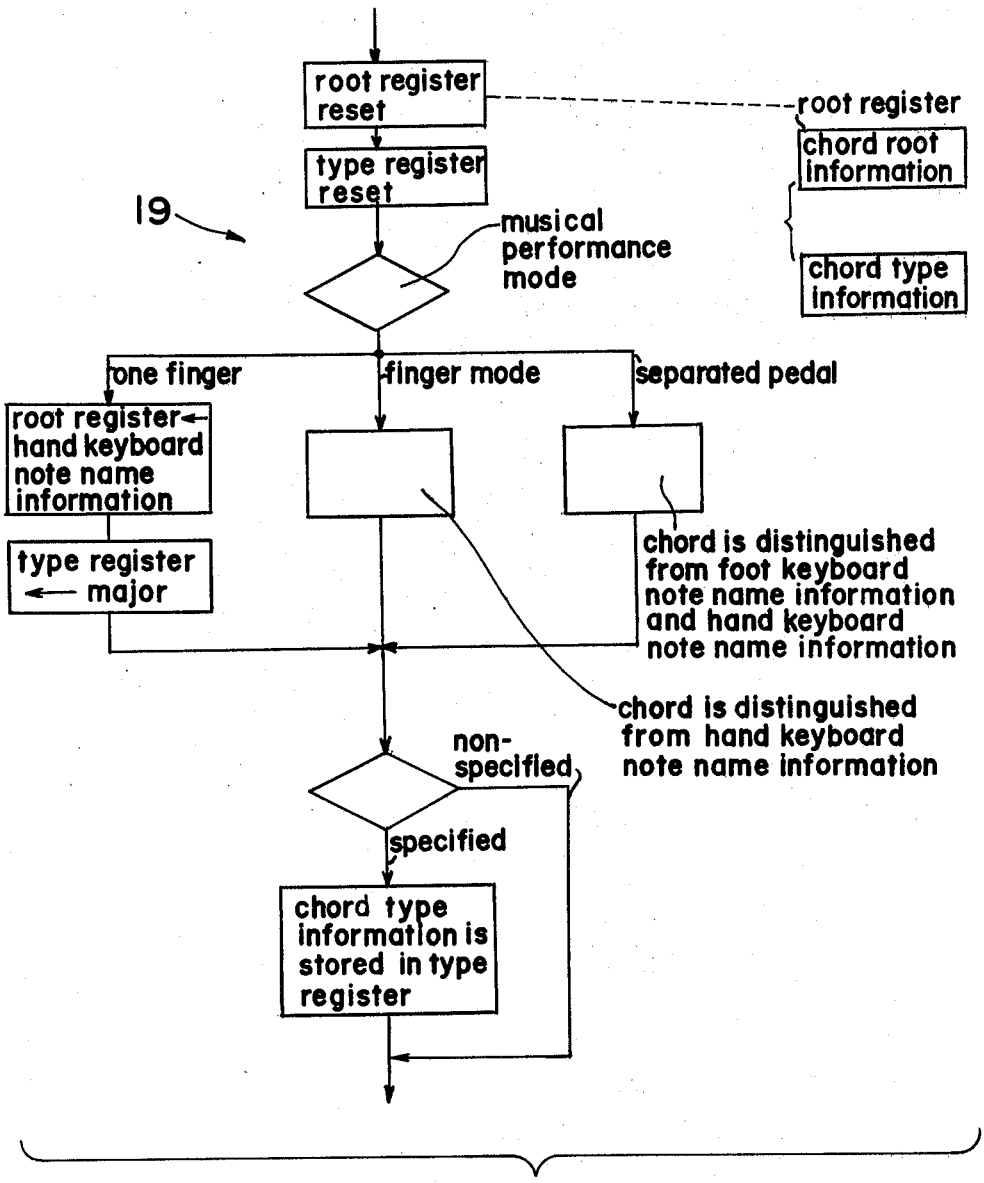
FIG. 5 is a sequence flow chart of the chord distinguishing circuit of FIG. 2.
Figure 6:
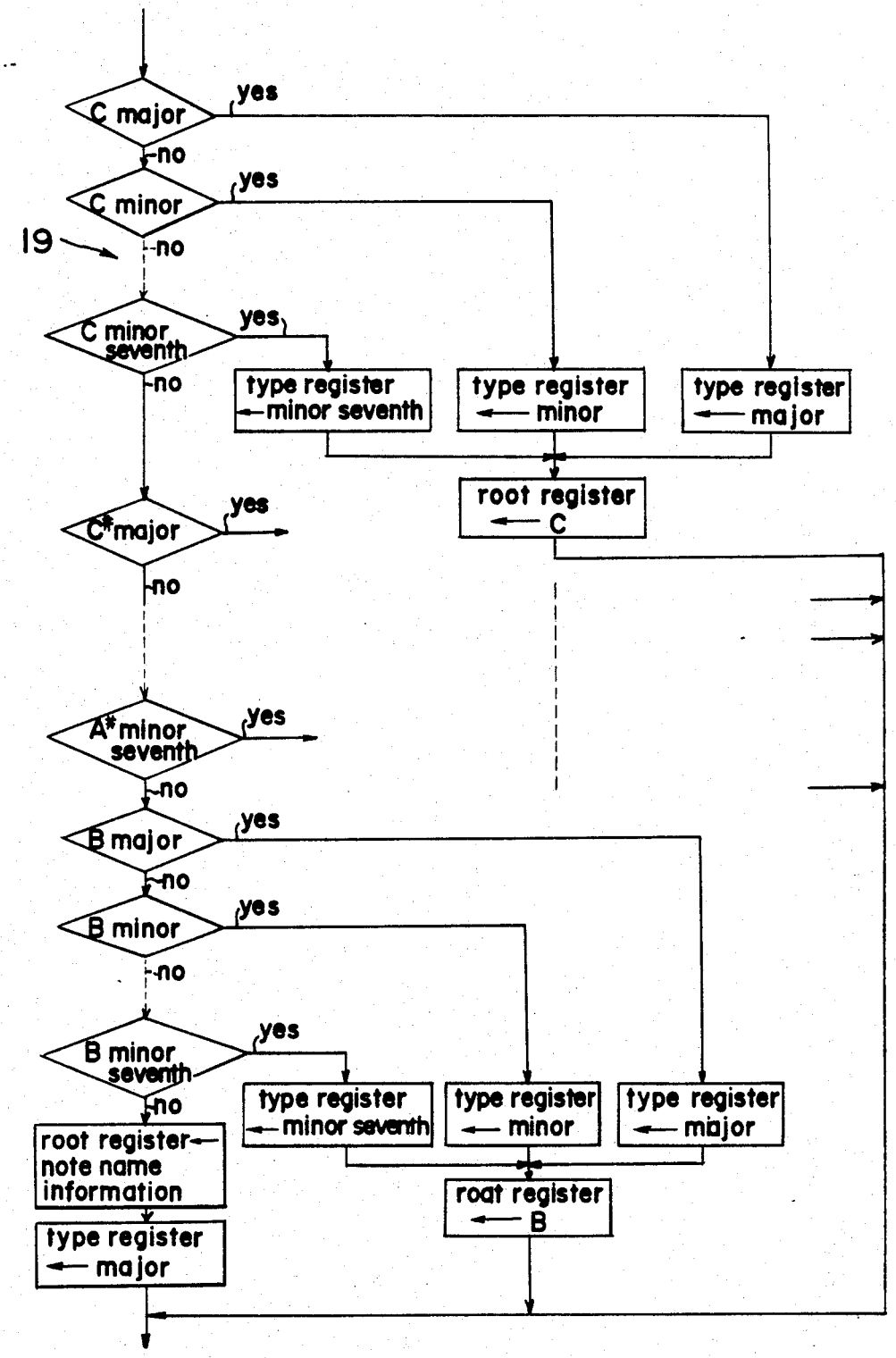
FIG. 6 is a sequence flow chart for distinguishing the chords of FIG. 2.

FIG. 5 and FIG. 6 show the sequence of the chord distinguishing circuit. As the chord information, the root (C, E, etc.) and type (major, minor, etc.) of the chord are provided. The sequence will be described in accordance with FIG. 5 and FIG. 6. A root register for storing the root of a chord distinguished as a register and a type register for storing the chord type are used, which are described in FIG. 5. Referring to FIG. 5, the root register and the type register are reset for the first time. The musical performance mode detected by the musical performance mode detecting circuit 20 is distinguished. In the case of one finger, the hand keyboard note name information is stored as the root and the major is stored as the type. In the case of the finger mode and the separated pedal mode, the chord distinguishing operation which has such sequence as described in FIG. 6 is performed. In the finger mode and the separated pedal, the difference of the chord distinguishing operation therebetween is the hand keyboard note name information in the case of the finger mode, and the foot keyboard note name information and the hand keyboard note name information in the case of the separated pedal. However, the general idea is the same. As shown in FIG. 6, the note name information is sequentially distinguished as to which chord corresponding to the information. When the note name information has conformed to a chord, the type and root of the chord are stored. When the note name information has not conformed to any chord, one note from the note name information is selected as a root and is stored in the root register. The major is stored in the type register as the chord type information. In the root information and type information provided as described hereinabove, the type register is corrected to the type information of the chord type specifying circuit 18, only when the specifying operation exists, by the chord specification existence information of the chord type specifying circuit 18 of FIG. 2 as shown in FIG. 5.

The chord information (root and type) provided as described hereinabove by the chord distinguishing apparatus 21 of FIG. 2 and the length information of the chord length specifying circuit 9 are written in the memory 11 by a write circuit 10.

Figure 7:
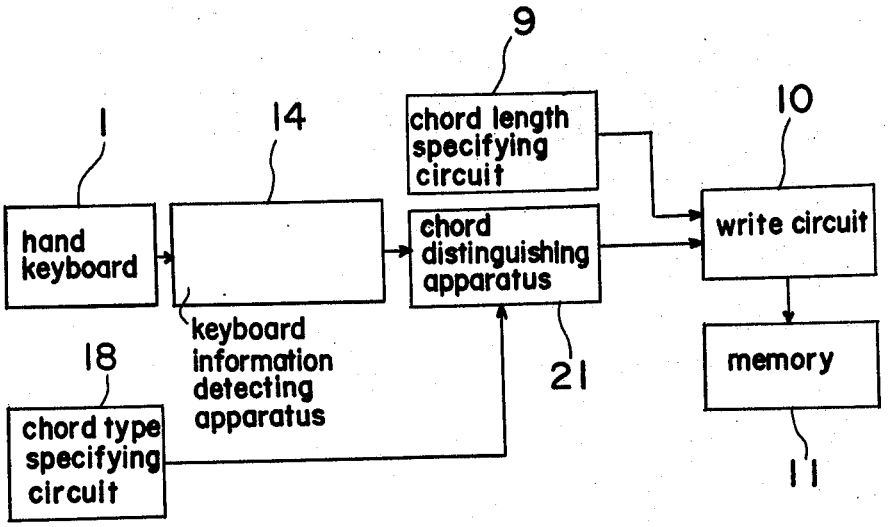
FIG. 7 is a block diagram of an electronic musical instrument in another embodiment of the present invention.

FIG. 7 shows an embodiment in the case of two types of one finger and the finger mode as the musical performance mode. The depressed key of the hand keyboard 1 is converted into the note name information by the depressed key note name detecting circuit 12. The chord distinguishing operation, which is equal to the sequence of FIG. 6, is performed by the chord distinguishing apparatus 21, which has the equal sequence to the finger mode of FIG. 5. The type register is corrected by the chord specification existence information of the chord type specifying circuit 18 of FIG. 7 and the chord type information to make the chord information (root and type). The length information of the chord of the chord length specifying circuit 9 and the chord are written in the memory 11 by the write circuit 10.

Figure 8:
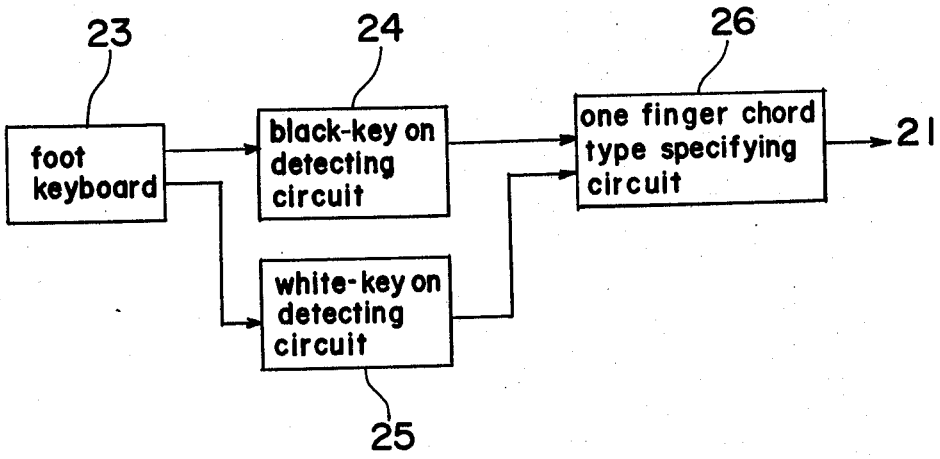
FIG. 8 is a block diagram showing one example of the chord type specifying circuit of FIG. 7.

Referring to FIG. 8, the specification inputting apparatus of a chord type specifying circuit 18 in FIG. 7 is constructed by the use of a foot keyboard. Four chord types are provided through the on and off condition of the black key and the white key.

Figure 9:
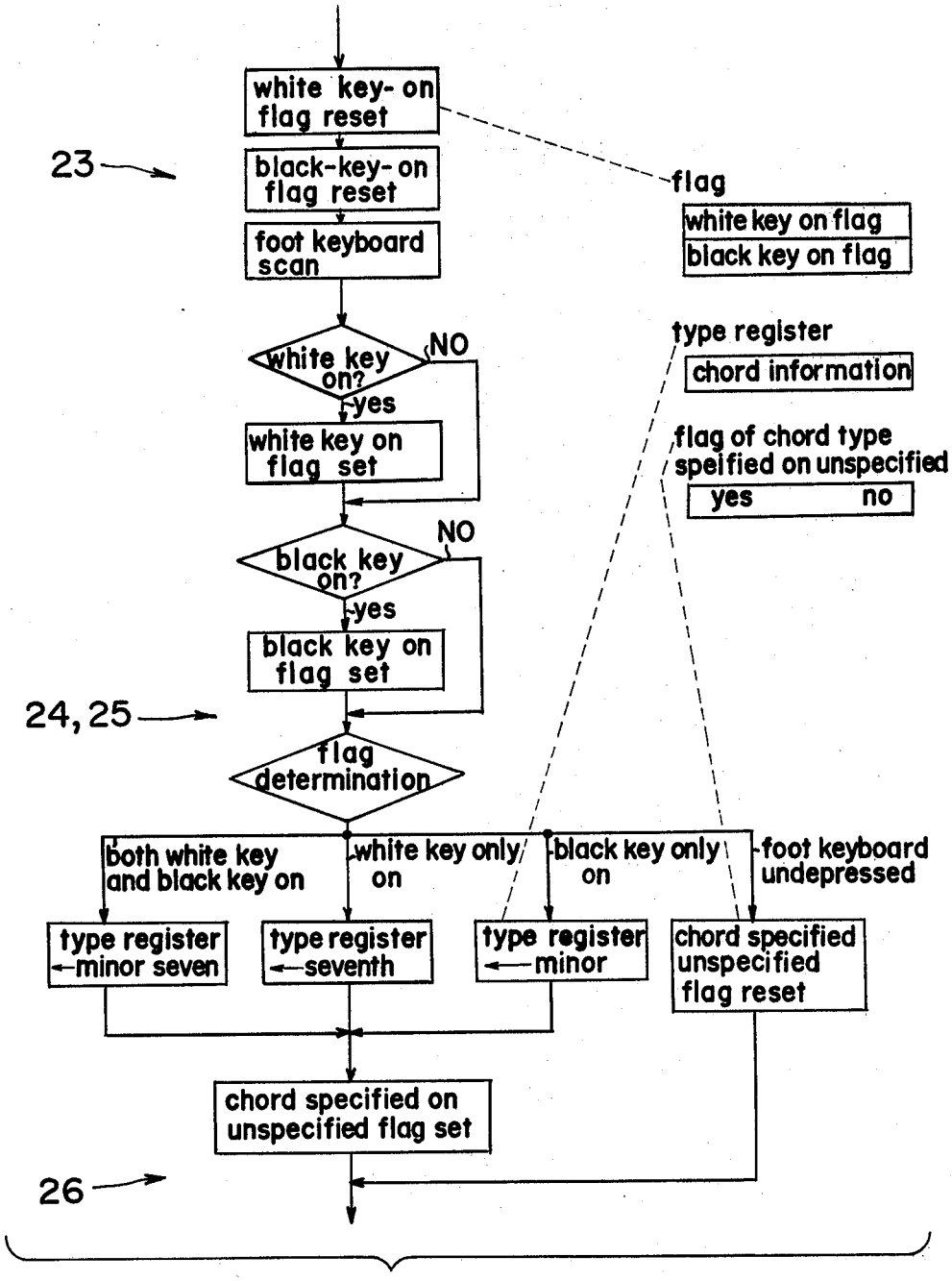
FIG. 9 is a sequence flow chart of the chord type specifying circuit of FIG. 7.

FIG. 9 shows a flow chart, which illustrates the operational sequence of FIG. 8. According to the description of the sequence, the distinguishing operation distinguishes a minor seven chord when the white key and the black key are both on as determined by the depressed key condition of the foot keyboard, and distinguishes a seventh chord when the white key only is on, and distinguishes a minor chord when the black key only is on, depending upon the condition of the depressed key of the foot keyboard. It is judged that the chord specification exists upon storing in the chord type register and no chord specification exists when the foot keyboard is not depressed. When no chord specification exists, the type of the chord becomes major in FIG. 7 so that four chord types of major, minor, seventh and minor seventh are provided.

The hand keyboard information detecting apparatus 14, the foot keyboard information detecting apparatus 17, the chord distinguishing apparatus 21, etc. of FIG. 2 are composed of microprocessors. The sequence shown in FIG. 3, FIG. 4, FIG. 5 and FIG. 6 may be carried out in accordance with a program. The same thing can be said even about the embodiment of FIG. 7 through FIG. 9.

According to the present invention as described hereinabove, the musical performance mode is not required to be specified in the chord storing operation so that the operation can be simplified and the operational errors can be reduced.

Although the present invention has been described and illustrated in detail, it is to be clearly understood that the same is by way of illustration and example only and is not to be taken by way of limitation, the spirit and scope of the present invention being limited only by the terms of the appended claims.

What is claimed is:

1. An electronic musical instrument comprising:

(a) a hand keyboard apparatus for a player to perform a melody or a music accompaniment;

(b) a hand keyboard information detecting means for detecting hand keyboard information including a hand keyboard tone name information of at least one depressed key and a hand keyboard depressed key number information obtained by counting the number of depressed keys in said hand keyboard apparatus;

(c) a pedal keyboard apparatus for a player to perform a base tone;

(d) a pedal keyboard information detecting means for detecting the pedal keyboard information including a pedal keyboard key depression presence information including whether said keys are depressed and a pedal keyboard tone name information of the depressed keys in said pedal keyboard apparatus;

(e) a musical performance mode detecting means for automatically judging the performance mode intended by a player based on said pedal keyboard key depression presence information and hand keyboard depressed key number information;

(f) a chord distinguishing means for distinguishing the root and type of chord being performed by the hand keyboard tone name information, the pedal keyboard tone name information, and the performance mode which is an output from the performance mode detecting means as automatically detected by the performance mode detecting means through the state of performance of a player; and (g) a chord type designating apparatus for modifying or designating the type of chord obtained by the chord distinguishing means.

2. An electronic musical instrument comprising:

(a) a hand keyboard apparatus for a player to perform a melody or a music accompaniment;

(b) a hand keyboard information detecting means for detecting hand keyboard information including a hand keyboard tone name information of at least one depressed key and a hand keyboard depressed key number information obtained by counting the number of depressed keys in said hand keyboard apparatus;

(c) a musical performance mode detecting means for automatically judging the performance mode intended by a player based on said hand keyboard depressed key number information;

(d) a chord distinguishing means for distinguishing root and type of the chord being performed by the hand keyboard tone name information, and the performance mode which is an output from the performance mode detecting means as automatically detected by the performance mode detecting means through the state of performance of a player; and (e) a chord type designating apparatus for correcting and designating the type of chord obtained by the chord distinguishing means.

3. An electronic musical instrument as claimed in claim 1, wherein the chord type designating device comprises a pedal keyboard apparatus.

4. An electronic musical instrument as claimed in claim 2, wherein the chord type designating device comprises a pedal keyboard apparatus.

5. An electronic musical instrument as claimed in claim 1, further comprising:

a chord length designating apparatus for designating the length of a chord;

a chord memory for storing the chord length, and root and type of the chord; and a write-in means for writing the chord into the chord memory.

6. An electronic musical instrument as claimed in claim 2, further comprising:

a chord length designating apparatus for designating the length of a chord;

a chord memory for storing the chord length, and root and type of the chord; and a write-in means for writing the chord into the chord memory.

7. An electronic musical instrument as claimed in claim 2, further comprising:

a chord length designating apparatus for designating the length of a chord;

a chord memory for storing the chord length, and root and type of the chord; and a write-in means for writing the chord into the chord memory.

8. An electronic musical instrument as claimed in claim 4, further comprising:

a chord length designating apparatus for designating the length of a chord;

a chord memory for storing the chord length, and root and type of the chord; and a write-in means for writing the chord into the chord memory.

* * * * *